US010822874B2

(12) United States Patent
Green

(10) Patent No.: US 10,822,874 B2
(45) Date of Patent: Nov. 3, 2020

(54) ENGINE MAINTENANCE LADDER

(71) Applicant: LockNClimb, LLC, Independence, KS (US)

(72) Inventor: Jeffrey Alan Green, Independence, KS (US)

(73) Assignee: LOCK N CLIMB, LLC, Independence, KS (US)

( * ) Notice: Subject to any disclaimer, the term of this patent is extended or adjusted under 35 U.S.C. 154(b) by 223 days.

(21) Appl. No.: 16/111,501

(22) Filed: Aug. 24, 2018

(65) Prior Publication Data

US 2020/0063491 A1 Feb. 27, 2020

(51) Int. Cl.

| | |
|---|---|
| ***E06C 1/39*** | (2006.01) |
| ***E06C 7/42*** | (2006.01) |
| ***E06C 7/16*** | (2006.01) |
| ***E06C 7/18*** | (2006.01) |
| ***E06C 1/28*** | (2006.01) |
| ***E06C 1/397*** | (2006.01) |

(52) U.S. Cl.

CPC ..... *E06C 1/39* (2013.01); *E06C 1/28* (2013.01); *E06C 1/397* (2013.01); *E06C 7/16* (2013.01); *E06C 7/182* (2013.01); *E06C 7/423* (2013.01)

(58) Field of Classification Search

CPC ... E06C 1/28; E06C 1/39; E06C 1/397; E06C 7/182; E06C 7/16

See application file for complete search history.

(56) References Cited

U.S. PATENT DOCUMENTS

| | | | | |
|---|---|---|---|---|
| 2,381,492 A * | 8/1945 | Fenner | E06C 1/393 | 182/106 |
| 2,423,477 A * | 7/1947 | Brimboeuf | E06C 1/20 | 182/22 |
| 2,624,590 A * | 1/1953 | Tilton | B25H 5/00 | 280/43.14 |
| 2,701,168 A * | 2/1955 | Schemers | B62B 3/10 | 182/116 |
| 2,962,112 A * | 11/1960 | Ramsberger | E04H 4/144 | 182/118 |
| 6,105,719 A * | 8/2000 | Lensing | E06C 1/397 | 182/116 |
| 6,926,365 B2 * | 8/2005 | Bottoms | A47C 9/025 | 182/129 |
| 7,048,091 B1 * | 5/2006 | Maguire | A47C 12/02 | 182/115 |

(Continued)

OTHER PUBLICATIONS

Non-Final Rejection dated Aug. 23, 2019, from U.S. Appl. No. 29/661,095, 16 sheets.

(Continued)

*Primary Examiner* — Alvin C Chin-Shue

(74) *Attorney, Agent, or Firm* — Katten Muchin Rosenman LLP

(57) ABSTRACT

Disclosed herein is a ladder adapted to service the engine of a tractor-trailer truck. The ladder comprises a set of rails having rungs extending between them. A set of rear rails is coupled to the set of rails. A pair of stability beams, terminating in ground contacting feet, extends rearward from the front rail and rear rails on each side of the ladder. A platform, extending rearward from between the set of rails, provides a planar surface allowing a mechanic access to the engine.

19 Claims, 9 Drawing Sheets

(56) References Cited

U.S. PATENT DOCUMENTS

| | | | | |
|---|---|---|---|---|
| 7,350,621 | B2 * | 4/2008 | Abraham | B62B 5/0083 16/29 |
| 7,828,116 | B2 * | 11/2010 | Vetesnik | A62B 1/04 182/115 |
| 8,002,084 | B2 | 8/2011 | Huang | |
| D722,182 | S | 2/2015 | Green | |
| D745,191 | S | 12/2015 | Green | |
| D796,694 | S | 9/2017 | Green | |
| D796,695 | S | 9/2017 | Walsh | |
| 9,834,987 | B2 * | 12/2017 | Lo | E06C 1/393 |
| D836,215 | S | 12/2018 | Green | |
| D840,055 | S | 2/2019 | Skubic | |
| D884,923 | S | 5/2020 | Green | |
| 2008/0093166 | A1 * | 4/2008 | Frolik | E06C 1/39 182/17 |
| 2011/0011674 | A1 * | 1/2011 | Kim | E06C 7/182 182/106 |
| 2015/0308190 | A1 | 10/2015 | Skubic | |
| 2015/0354276 | A1 * | 12/2015 | Green | E06C 7/46 182/172 |
| 2017/0226803 | A1 * | 8/2017 | Russell | E06C 1/16 |

OTHER PUBLICATIONS

Non-Final Rejection dated Aug. 26, 2019, from U.S. Appl. No. 29/664,427, 13 sheets.

Notice of Allowance dated Jan. 16, 2020, from U.S. Appl. No. 29/664,427, 14 sheets.

Final Rejection dated Apr. 22, 2020, from U.S. Appl. No. 29/661,095, 9 sheets.

Notice of Allowance dated Jun. 11, 2020, from U.S. Appl. No. 29/661,095, 20 sheets.

* cited by examiner

ENGINE MAINTENANCE LADDER

FIELD OF THE INVENTION

This application discloses a ladder particularly suited for performing engine maintenance of tractor-trailer trucks. More particularly, the present application discloses a ladder with an integrated platform allowing easy access to the engine of a tractor-trailer truck.

BACKGROUND

Large trucks, and in particular tractor-trailer trucks, require constant maintenance because they are typically used in long haul operations, such as shipping and delivery. As a result, the engines of tractor-trailer trucks must constantly be serviced. In most tractor-trailer trucks, the hood is hinged to allow easy access to the entire engine of the tractor-trailer cab. However, the engine is at a much higher height than that of a typical vehicle and requires a ladder or other device to access the majority of the engine.

A stepladder is typically used to access the engine of a tractor-trailer truck during maintenance. However, when using the stepladder, the mechanic must typically lean over the engine to access various components, leading to potential injury and/or unnecessary strain. Therefore, a need clearly exists for a ladder, which provides easier access to the engine of tractor-trailer trucks while remaining stable and portable.

SUMMARY

Disclosed herein is a ladder adapted to service the engine of a tractor-trailer truck. The ladder comprises a set of rails having rungs extending between them. A set of rear rails is coupled to the set of rails. A pair of stability beams, terminating in ground contacting feet, extends rearward from the front rail and rear rails on each side of the ladder. A platform, extending rearward from between the set of rails, provides a planar surface allowing a mechanic access to the engine.

DESCRIPTION OF THE DRAWINGS

These and other advantages of the present invention will be readily understood with reference to the following specifications and attached drawings wherein.

DETAILED DESCRIPTION

Preferred embodiments of the present invention will be described herein below with references to the accompanying drawings. In the following description, well-known functions or constructions are not described in detail, since such minutia would obscure the invention in unnecessary trivia.

Figure 1:
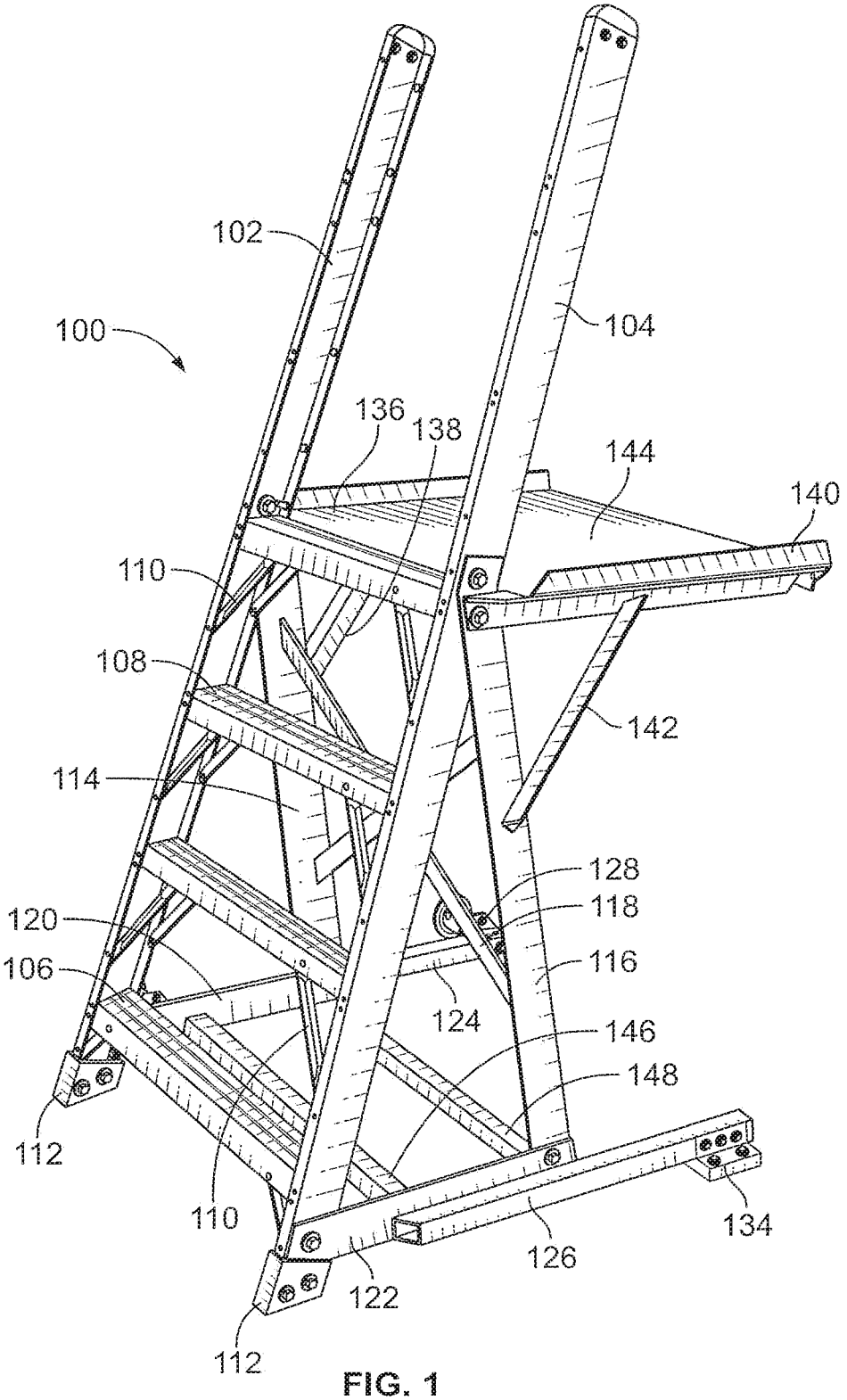
FIG. 1 is a front angular perspective view of a first embodiment of a ladder of the present invention.

Referring to FIG. 1, depicted is a front perspective view of ladder 100. A front of ladder 100 comprises opposing rails 102 and 104 having therein between a plurality of rungs 106. The rails 102 and 104 may be parallel to each other or may be angled towards each other, as depicted, to provide greater stability. If rails 102 and 104 are angled towards each other, rungs 106 have a decreasing width along a height of ladder 100.

Rails 102 and 104 are preferably mirror images of each other and made from the same material, such as wood, steel, aluminum, fiberglass, or another metal. Preferably, rails 102 and 104 are formed from cut or pressed aluminum.

Rungs 106 may be joined to rails 102 and 104 using any known techniques, such as welding or bolting. In the instant embodiment, four rungs 106 are shown joined to rails 102 and 104 using welding. The vertical spacing or width of rungs 106 can be varied to accommodate different sized rails 102 and 104 or for different applications. Preferably, rungs 106 are formed from a similar material to that of rails 102 and 104. A top surface of rungs 106 is provided with a flat non-slip surface 108 that is corrugated, knurled, dimpled, coated with skid-resistant material, or otherwise treated to minimize slipping as is known in the art.

Each rung 106 is further provided with one or more angled braces 110 coupled to an interior of rails 102 or 104 and a bottom surface of rungs 106. Angled braces 110 provide extra support for weight placed on rungs 106. Particularly, in servicing engines of tractor-trailer trucks, rungs 106 may need to bear the weight of a person far longer than a rung of a normal ladder. Angled braces 110 help to alleviate the extra weight, which may be experienced by rungs 106 in comparison to a typical ladder. However, depending upon the application, angled braces 110 may also be omitted if weight is of a concern. Angled braces 110 are preferably formed from wood, steel, aluminum, fiberglass, or another metal.

The bottom of each rail 102 and 104 is fitted with feet 112 where contact is made with the ground. If ladder 100 is primarily used on a level surface, such as in a mechanic's garage, foot 112 may only serve to protect a bottom of rails 102 and 104 and can be affixed to rails 102 and 104 through a bolted or welded connection. The underside of feet 112 may comprise a gripping material to minimize slippage. For example, the gripping material could be a rubber pad, a smooth hard surface, or a spiked surface. In other embodiments, the underside of feet 112 may comprise a large planar foot surface to create a larger surface area to prevent sinking of ladder 100 (e.g., on dirt or sand). Depending on the choice of feet 112, the ladder 100 can be used on ground surfaces such as concrete, dirt, steel, tile, grating, brick, stone and most floor materials.

Figure 2:
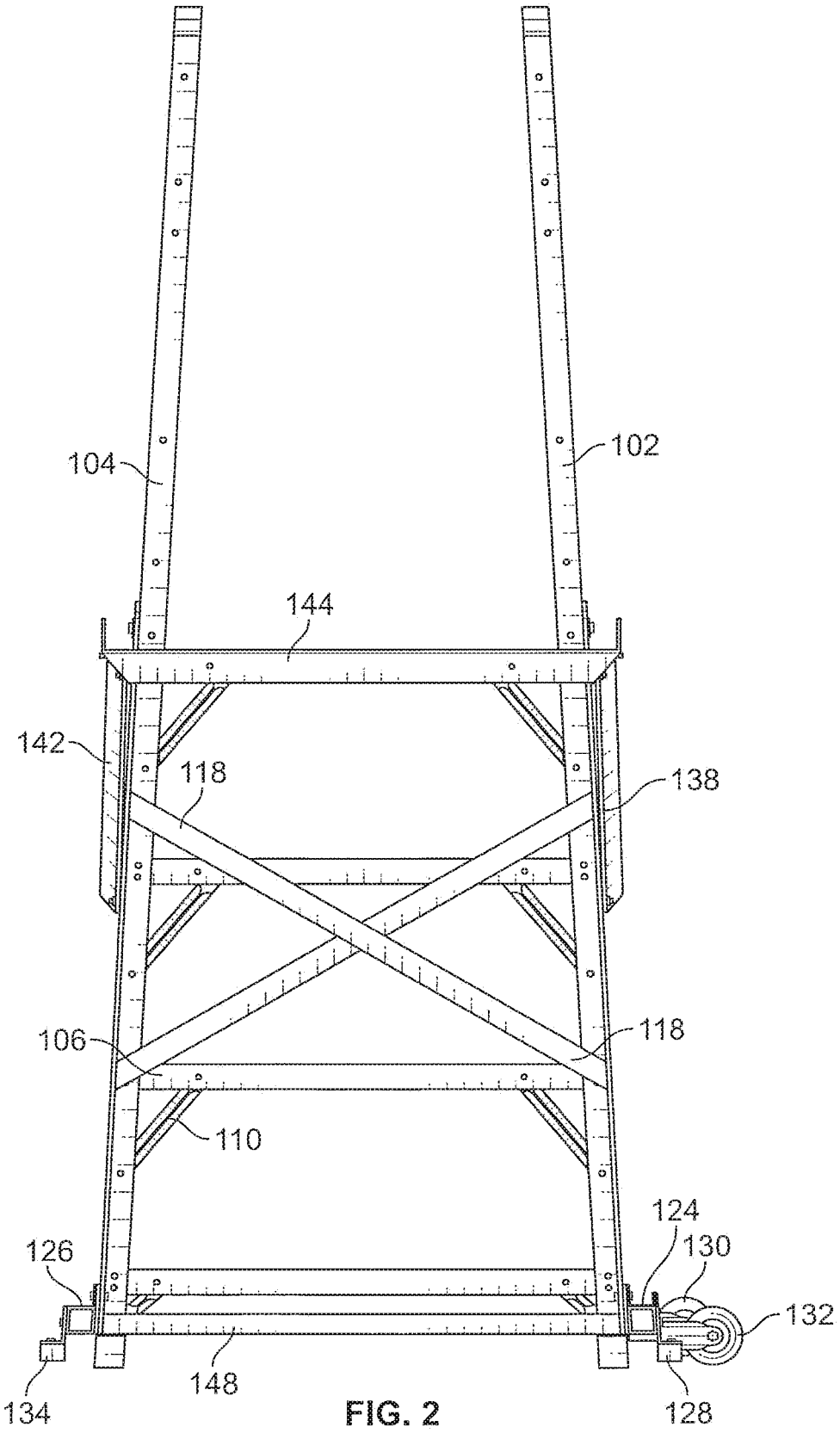
FIG. 2 is a rear view of the first embodiment of the ladder of FIG. 1.
Figure 3:
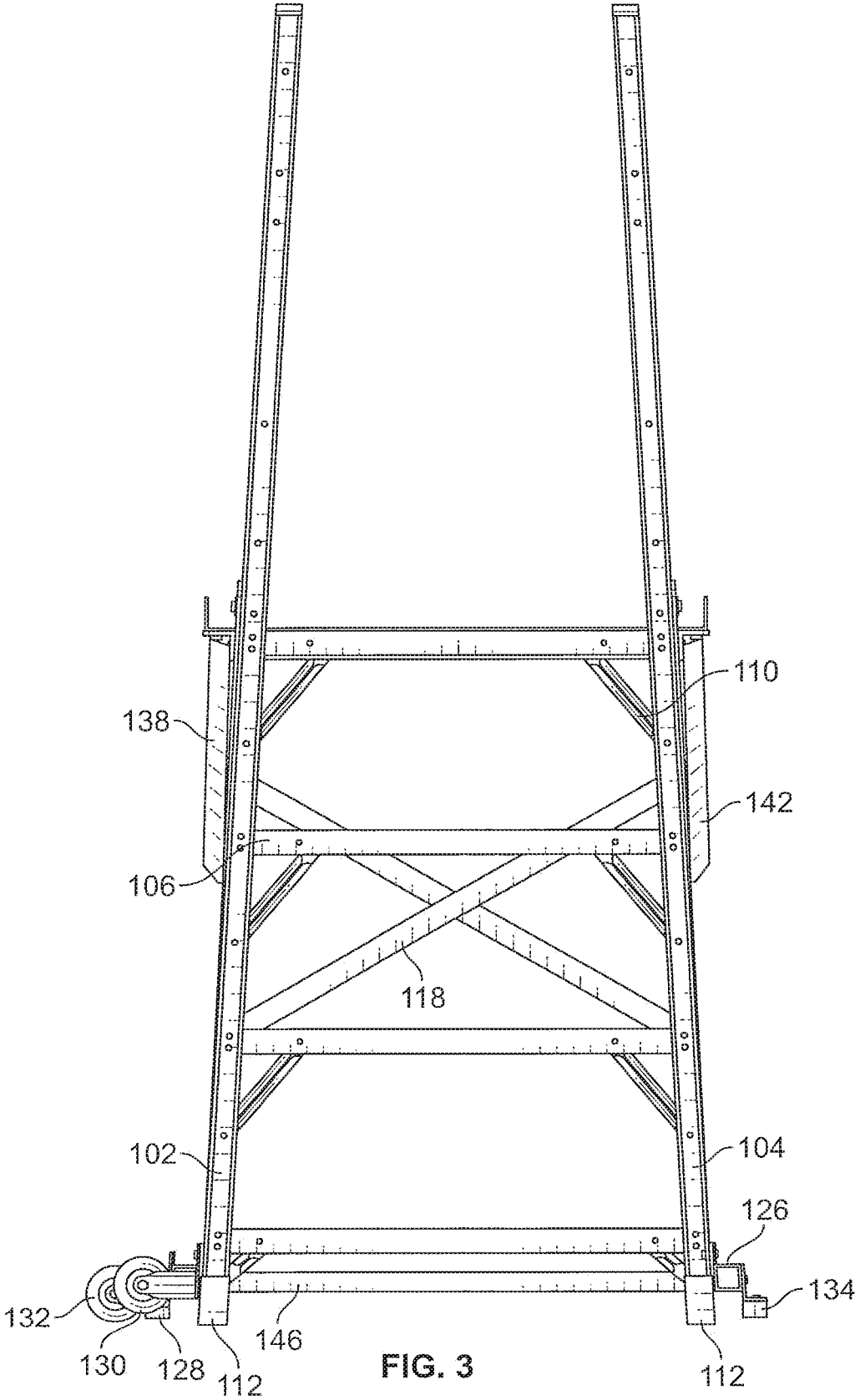
FIG. 3 is a front view of the first embodiment of the ladder of FIG. 1.

Rail 102 is joined to rear rail 114 and rail 104 is joined to rear rail 116 using a bolted connection as depicted in FIG. 1. As shown better in FIG. 2, a pair of cross beams 118, arranged in an X-pattern, is used to provide additional stability for ladder 100 and to maintain the spacing between rear rails 114 and 116. Cross beams 118 are preferably welded to rear rails 114 and 116, although a replaceable connection, such as a bolted connection, is also suitable. Rear rail 114, rear rail 116, and cross beams 118 are all preferably formed from wood, steel, aluminum, fiberglass, or another metal.

Figure 4:
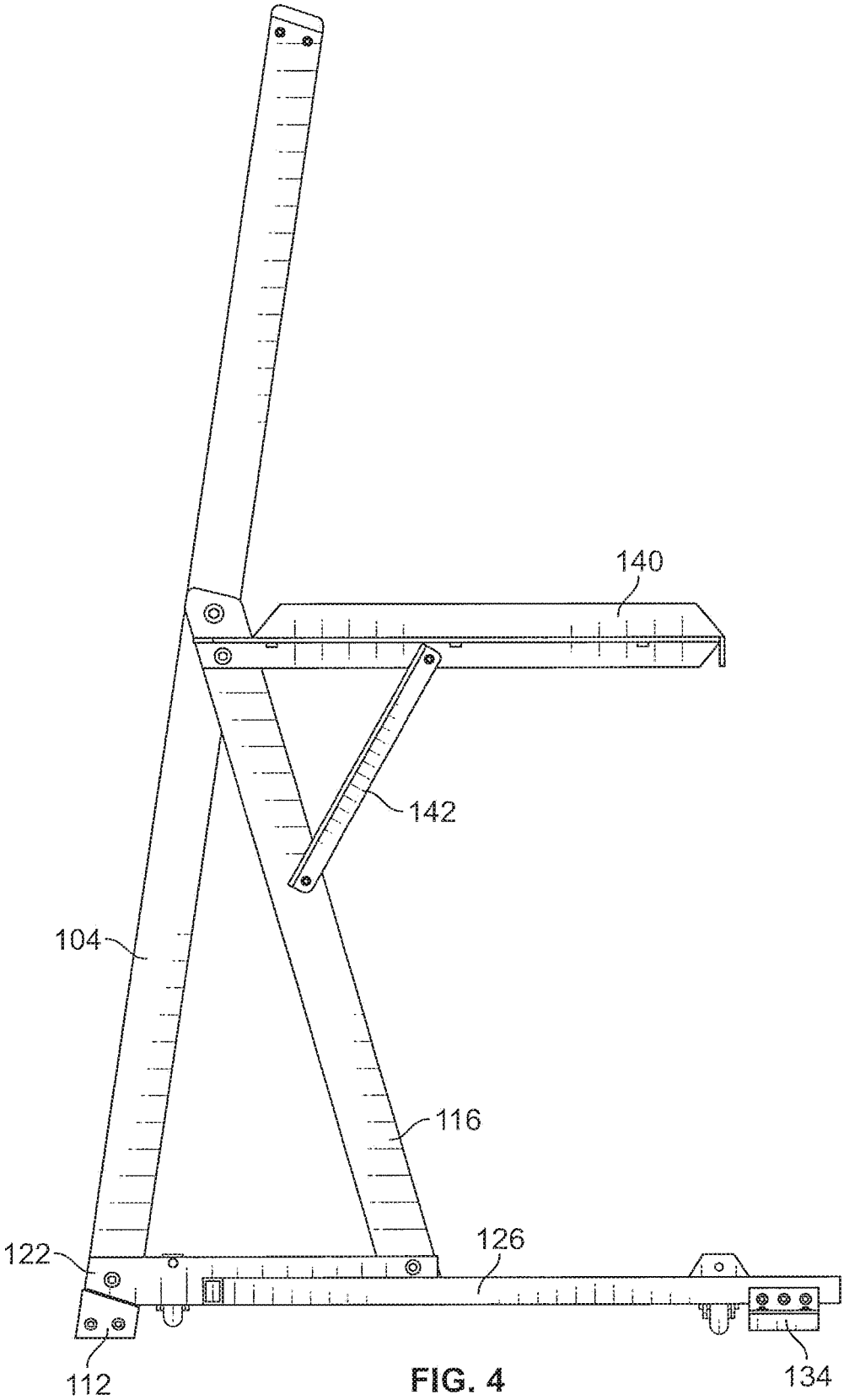
FIG. 4 is a right side view of the first embodiment of the ladder of FIG. 1.
Figure 5:
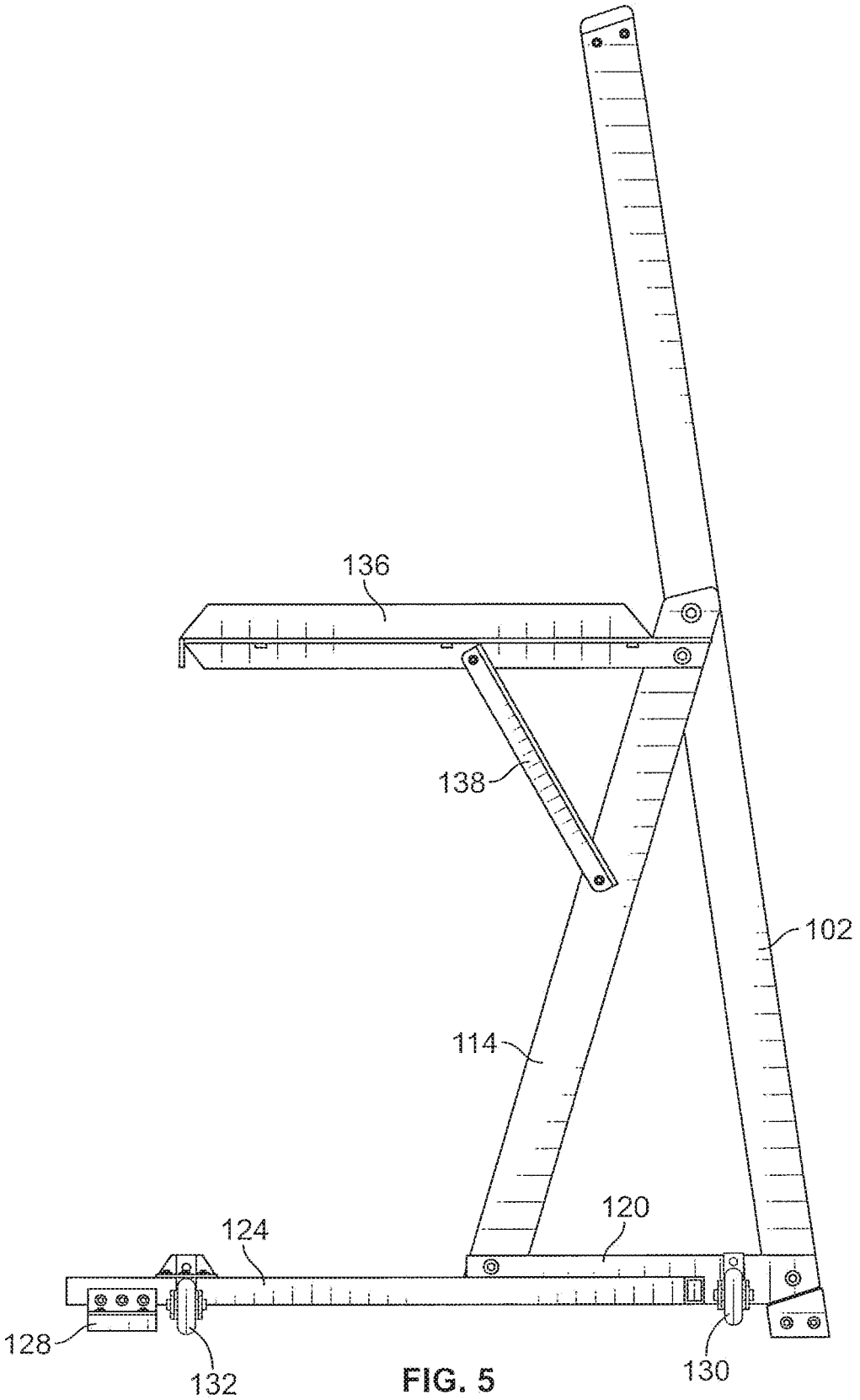
FIG. 5 is a left side view of the first embodiment of the ladder of FIG. 1.

A bottom of rear rail 114 is coupled to rail 102 just above foot 112 using beam 120 (FIG. 5). Similarly, a bottom of rear rail 116 is coupled to rail 104 just above foot 112 using beam 122 (see FIG. 4). The connection between rail 104, rear rail 116 and beam 122 forms a rigid triangle that provides stability to ladder 100. Likewise, the connection between rail 102, rear rail 114, and beam 120 forms another rigid triangle on the opposing side of ladder 100. Thus, both rear rail 114 and rear rail 116 do not extend all the way to the ground surface, as depicted in FIGS. 4 and 5.

Referring to FIG. 5, a first stability beam 124, coupled to beam 120, extends rearward from rail 104 as is substantially parallel to the ground and beam 120. A rear portion of first stability beam 124 is provided with a rear foot 128 that contacts the ground surface when ladder 100 is in use. Similar to feet 112, rear foot 128 may be of any size, shape, or composition as required during the use of ladder 100.

Figure 6:
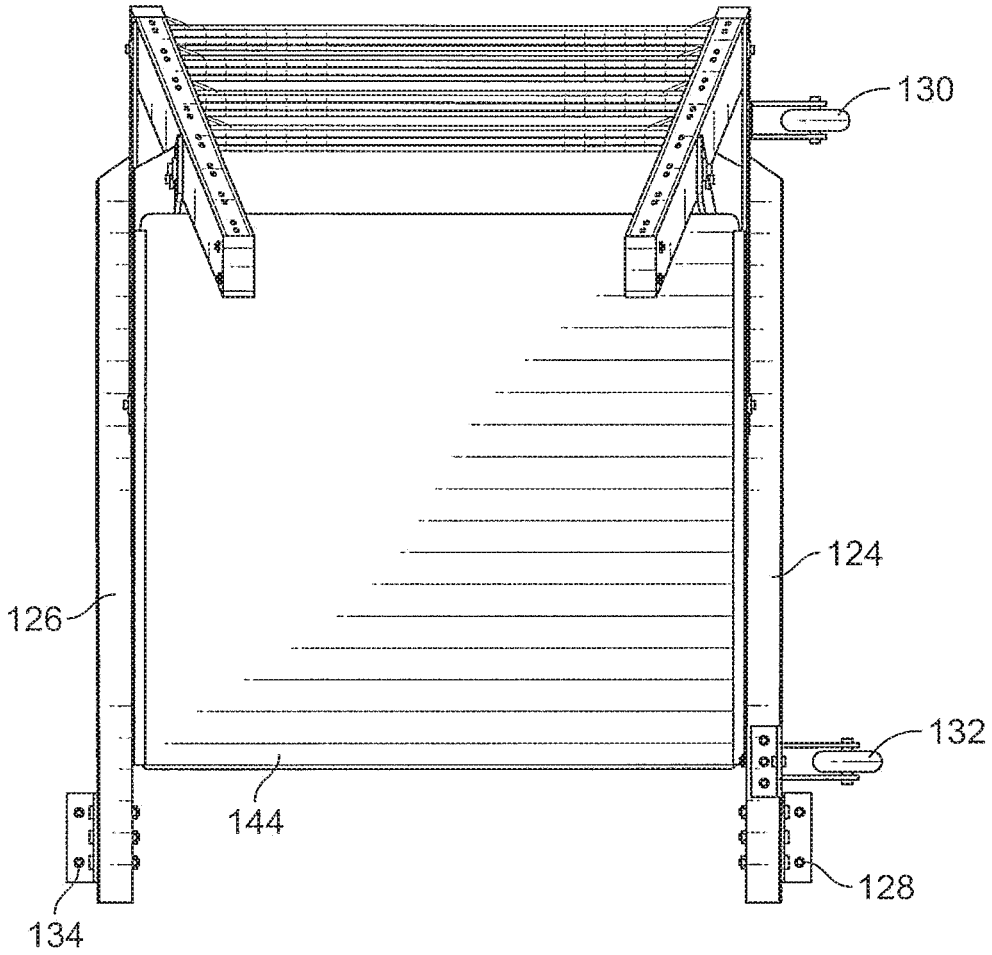
FIG. 6 is a top view of the first embodiment of the ladder of FIG. 1.

A first wheel 130 is coupled to beam 120 in the vicinity of rail 104 and a second wheel 132 is coupled to first stability beam 124. As better shown in FIG. 6, the edges of first wheel 130 and second wheel 132 need not be aligned.

Referring now to FIG. 4, a second stability beam 126 is coupled to an exterior of beam 122 and is substantially parallel to the round and beam 122. A rear portion of second stability beam 126 is provided with a rear foot 134 that contacts the ground surface when ladder 100 is in use. Similar to feet 112, rear foot 134 may be of any size, shape, or composition as required during the use of ladder 100. Rear foot 128 and rear foot 134 may also differ in size, shape, and composition from each other if needed. First wheel 130 and second wheel 132 can also alternatively be coupled to beam 122 and second stability beam 126, respectively. Alternatively, wheels may be provided on both sides of ladder 100.

As will be described later, first stability beam 124 and second stability beam 126 extend a predetermined distance rearward from rails 102 and 104, respectively. This prevents ladder 100 from tipping when a large weight, such as a human or other equipment, is placed on ladder 100.

A first platform beam 136 is coupled to an exterior of rail 102 and rear rail 114 as depicted in FIGS. 1 and 5. First platform beam 136 has a length greater than that of beam 120 but does not extend rearward past rear foot 128. An angled support brace 138, coupled to an exterior of rear rail 114 and first platform beam 136, serves to support any significant weight and provides added stability to ladder 100.

A second platform beam 140 is coupled to an exterior rail 104 and rear rail 116 as depicted in FIGS. 1 and 4. Second platform beam 140 has a length greater than that of beam 122 but does not extend rearward past rear foot 128. An angled support brace 142, coupled to an exterior of rear rail 116 and second platform beam 140, serves to support any significant weight and provides added stability to ladder 100.

A platform 144 is provided between first platform beam 136 and second platform beam 140. The platform 144 may be a planar piece of metal that is slid between rails on first platform beam 136 and second platform beam 140 or first platform beam 136, second platform beam 140, and platform 144 may all be integrally formed from a single piece of metal, for example. As shown in FIG. 1, a top surface of both first platform beam 136 and second platform beam extends above a top surface of platform 144 to form a lip on two sides of platform 144. A front of platform 144 is preferably parallel to a top surface of the highest rung 106 of ladder 100. And, like rungs 106, a top surface of platform 144 preferably comprises a gripping surface that is corrugated, knurled, dimpled, coated with skid-resistant material, or otherwise treated to minimize slipping as is known in the art. Alternatively, top rung 106, platform 144, first platform beam 136, and second platform beam 140 could all be formed or manufactured as a single workpiece to reduce assembly time.

Support brace 138 and support brace 142 support any weight that is placed on the top surface of platform 144 for extended periods of time. As will be shown later, a mechanic can stand on platform 144 comfortably for extended periods of time to access the engine of a tractor-trailer truck. Specifically, platform 144 can support a great deal of weight without the ladder tipping due to the rearward placement of rear foot 128 and rear foot 134.

Rails 102 and 104 purposely do not have any rungs 106 located above platform 144. This allows rails 102 and 104 to be used as stabilizing handles or grips while a user is standing on platform 144. Rails 102 and 104 preferably have a grip length such that the rails 102 and 104 extend upwards above a standing grip height of an average height of a male or female (e.g., 3-4 feet). In another embodiment, the upper portions of rails 102 and 104 may be provided with telescoping extensions to allow a mechanic to selectively adjust the grip height of rails 102 and 104. Further, rails 102 and 104, above platform 144, may be coated with an anti-slip surface to provide better grip.

To provide added stability to ladder 100, an interior of beam 120 is preferably coupled to an interior of beam 122 using first stabilizing beam 146. A second stabilizing beam 148 is coupled, on a first side, to an interior of beam 120 and rear rail 114, and, on a second side, to an interior of beam 122 and rear rail 116.

Figure 7:
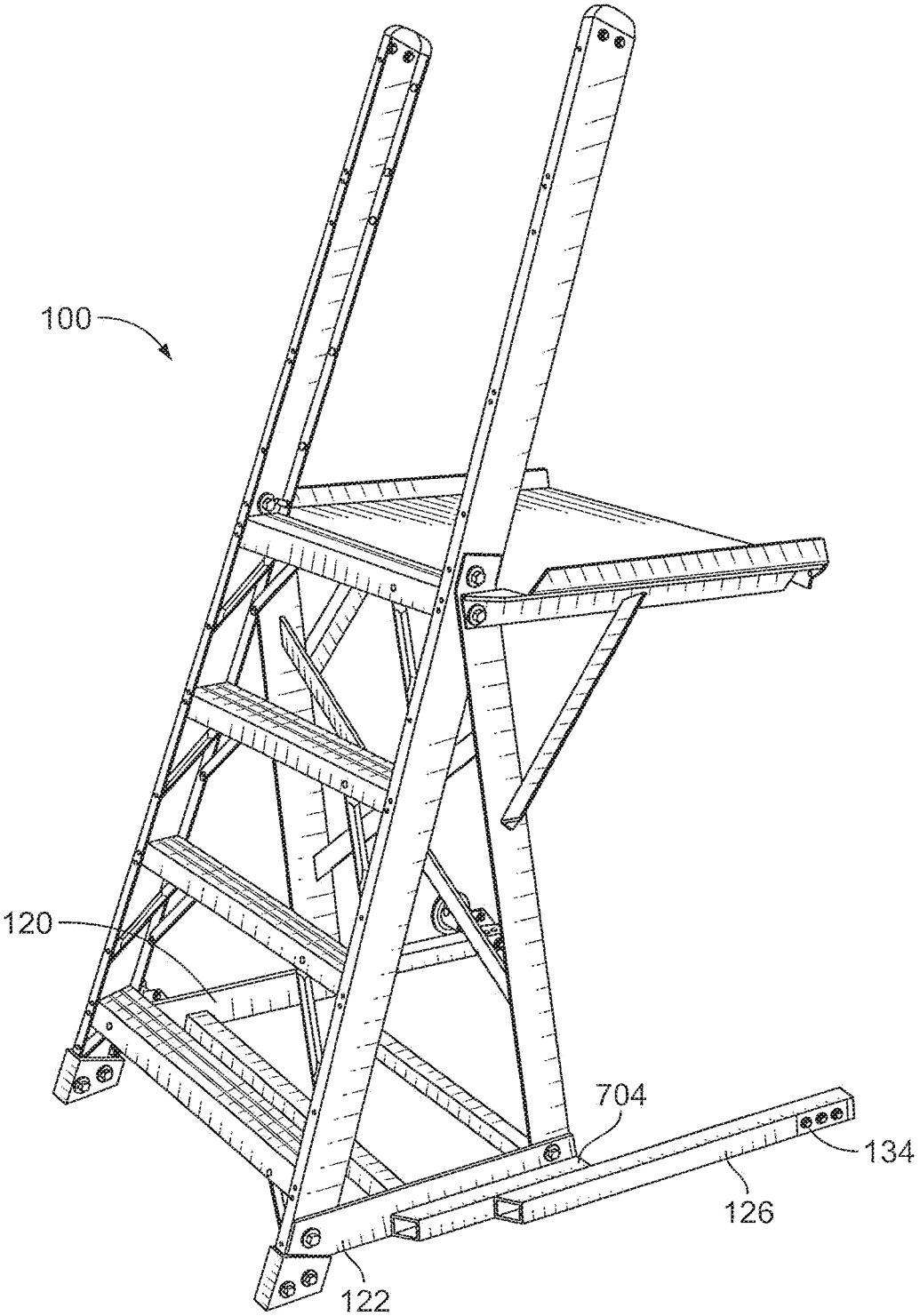
FIGS. 7 and 8 are front perspective and top views, respectively, of a second embodiment of a ladder of the present invention.
Figure 8:
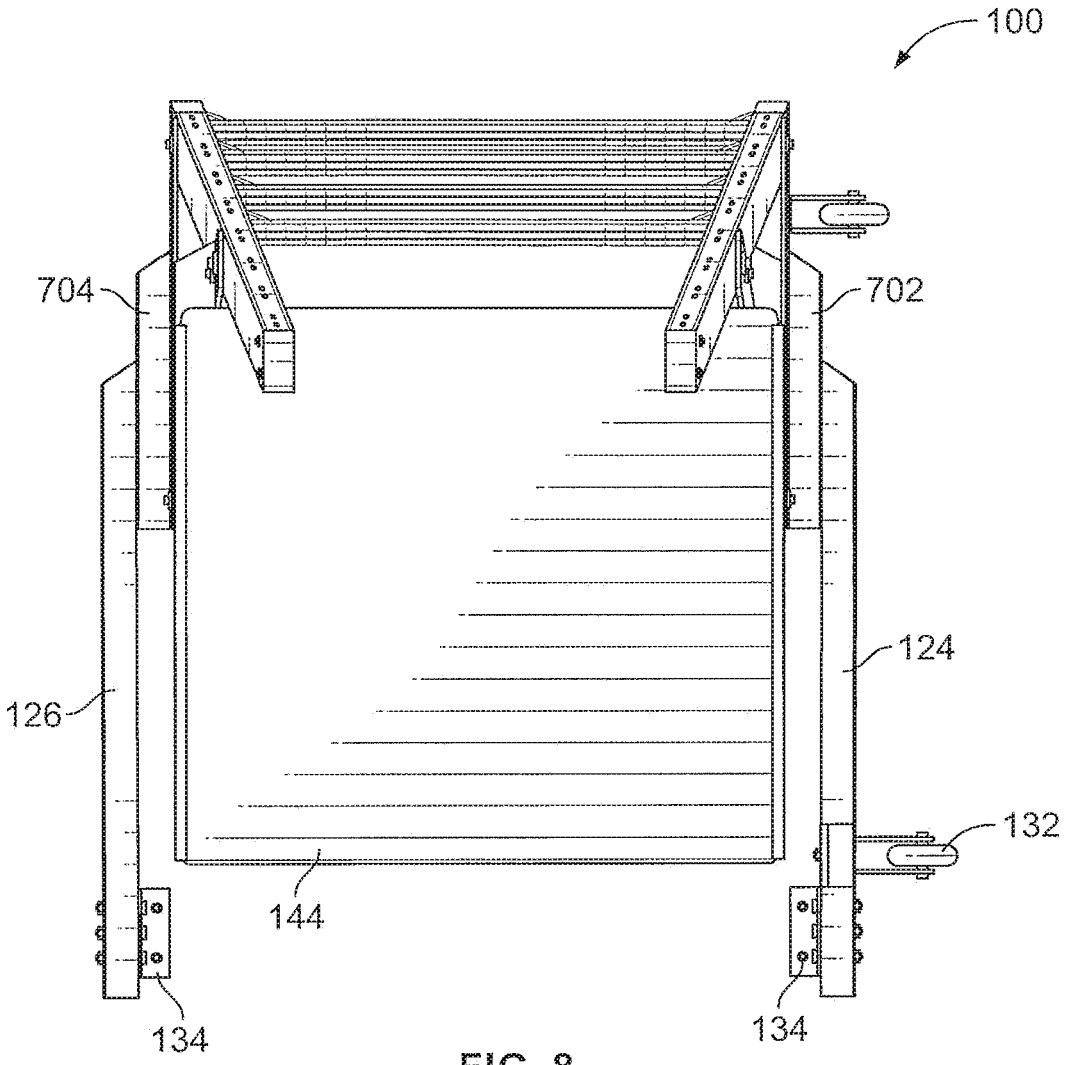

A second embodiment of ladder 100 is depicted in FIGS. 7 and 8. For brevity, only the differences between the first embodiment of ladder 100 depicted in FIGS. 1-6 and the second embodiment depicted in FIGS. 7 and 8 will be described.

As previously state, the described components forming ladder 100 may be coupled to each other using releasable connections, such as bolts, or more permanent connections, such as welding. Further, the various element of ladder 100 that have been described may be integrally formed or separately formed and then later joined together. In this embodiment, a first spacer beam 702 is provided between beam 120 and first stability beam 124 (FIG. 8) and a second spacer beam 704 is provided between beam 122 and second stability beam 126 (FIGS. 7 and 8). Thus, in this embodiment, a spacing between stability beams 124 and 126 is increased by the combined thickness of first spacer beam 702 and second spacer beam 704. Because of the increased spacing, the orientation of rear feet 128 and 134 has been changed to face inward toward a center of ladder 100 (FIG. 8).

Figure 9:
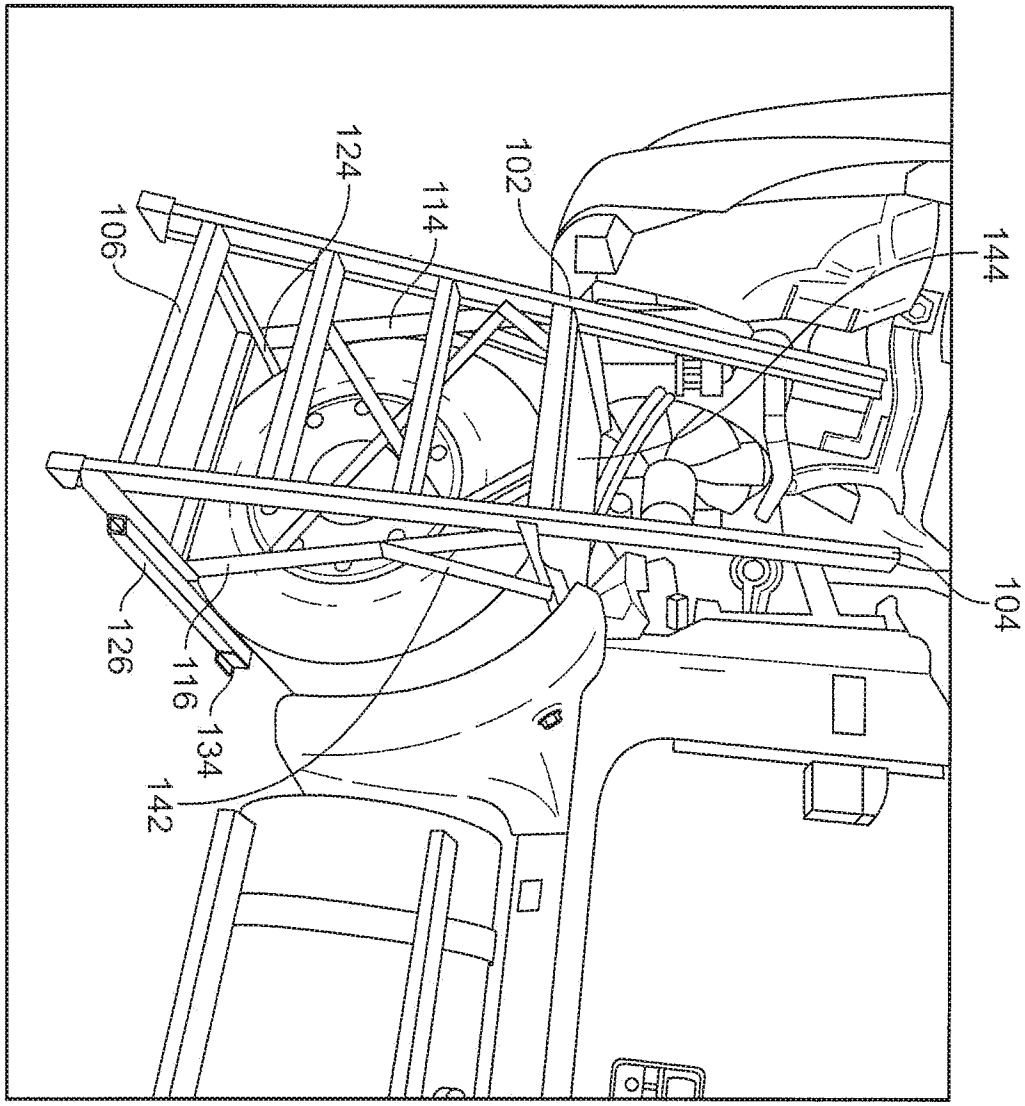
FIG. 9 is a view of the ladder being used in conjunction with a tractor-trailer truck.

FIG. 9 depicts a view of the ladder 100 of FIGS. 1-6 placed for servicing the engine of a tractor-trailer truck. As shown, a spacing between stability beams 124 and 126 is great enough to accommodate the ground clearance of the tractor-trailer truck wheel. The placement of the stability beams 124 and 126 on the sides of the tractor-trailer truck wheel also allows the wheel to help prevent ladder 100 from accidentally tipping left or right, and thus increases stability of ladder 100. The ladder 100 can be placed close to the tractor-trailer truck such that rear rails 114 and 116 abut a front surface of the wheel. This allows platform 144 to extend over the top of the heel and into the compartment containing the engine. Thus, in contrast to prior art ladders which only provide access to the side of the engine, ladder 100 allows a mechanic to more easily access the engine because of the additional extension provided by platform 144. In addition, as shown, the top portions of rails 102 and 104 provided a gripping surface that a mechanic can use to stabilize themselves while working on the engine.

Support braces 138 and 142 are angled such that they do not contact the wheel and thus do not interfere with placement of ladder 100. The rearward placement of rear feet 128 and 134 allows a user to confidently place his/her entire weight anywhere on platform 144 without worrying about ladder 100 tipping or rocking.

After use, the ladder 100 can be removed from the engine by pulling back on ladder 100 so that rear feet 128 and 134 clear the wheel of the tractor-trailer. First wheel 130 and second wheel 132 can then be used to move ladder 100 to a different location.

While the present invention has been described with respect to what are currently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation, so as to encompass all such modifications and equivalent structures and functions.

All U.S. and foreign patent documents, all articles, all brochures and all other published documents discussed above are hereby incorporated by reference into the Detailed Description of the Preferred Embodiment.

The invention claimed is:

1. A ladder comprising:
a first front side rail;
a second front side rail;
a plurality of rungs, wherein each rung is coupled to an inner surface of the first front side rail and an inner surface of the second front side rail;
a first rear side rail coupled to the first front side rail;
a second rear side rail coupled to the second front side rail;
a platform extending in a rearward direction away from the first front side rail and the second first side rail;
a first stabilizer beam assembly extending in the rearward direction and coupled to the first front side rail and the first rear side rail;
a second stabilizer beam assembly extending in the rearward direction and coupled to the second front side rail and the second rear side rail,
wherein a length of the platform is less than a length of the first stabilizer beam assembly and a length of the second stabilizer beam assembly;
wherein the first stabilizer beam assembly comprises:
a first stabilizing beam coupled to an exterior surface of the first front side rail and an exterior surface of the first rear side rail; and
a second stabilizing beam,
wherein a front end of the second stabilizing beam is coupled to an outer surface of the first stabilizing beam at a location between the first front side rail and the first rear side rail, and
wherein a rear end of the second stabilizing beam is coupled to a foot.

2. The ladder according to claim 1, wherein a width of the platform extends past an exterior surface of the first rear side rail and an exterior surface of the second rear guide rail.

3. The ladder according to claim 1, wherein opposing sides of the platform are coupled to an upward lip along at least along a portion of the opposing sides.

4. The ladder according to claim 1, wherein a top surface of the platform is substantially planar with a top surface of a highest rung of the plurality of rungs.

5. The ladder according to claim 1, further comprising:
a first support brace coupled to the first rear side rail and the platform; and
a second support brace coupled to the second rear side rail and the platform.

6. The ladder according to claim 1, further comprising:
a pair of cross beams arranged in an X-pattern,
wherein a first end of the pair of cross beams is coupled to the first rear side rail and a second and of the pair of cross beams is coupled to the second rear side rail.

7. The ladder according to claim 1, further comprising:
a plurality of wheels coupled to an exterior surface of the first stabilizer beam assembly or an exterior surface of the second stabilizer beam assembly.

8. The ladder according to claim 7, wherein the plurality of wheels only engage a ground surface when the ladder is tilted past a predetermined angle.

9. The ladder according to claim 1, wherein the foot comprises a planar ground contacting portion extending in an outward direction perpendicular to the rearward direction and away from an outer surface of the first front side rail.

10. The ladder according to claim 9, wherein the planar ground contacting portion is an only portion of the first stabilizer beam assembly in contact with a ground surface.

11. The ladder according to claim 1, wherein the first side rail and the second side rail extend a predetermined distance above a top surface of the platform.

12. The ladder according to claim 11, wherein the predetermined distance is 1-2 meters.

13. The ladder according to claim 1, wherein the first front side rail is not parallel to the second front side rail.

14. The ladder according to claim 1, further comprising:
a first foot coupled to an end of the first front side rail,
wherein a front end of the first stabilizer beam assembly is coupled to the first front side rail above the first foot but below a first rung of the plurality of rungs.

15. A ladder comprising:
a first front side rail;
a second front side rail;
a plurality of rungs, wherein each rung is coupled to the first front side rail and second front side rail;
a first rear side rail coupled to the first front side rail;
a second rear side rail coupled to the second front side rail;
a platform extending in a rearward direction away from the first front side rail and the second first side rail;
a first stabilizer beam assembly extending in the rearward direction and coupled to the first front side rail and the first rear side rail, the first stabilizer beam assembly comprising:
a first beam having a first end and a second end,
wherein the first end of the first beam is coupled to an exterior surface of the first front side rail, and
wherein the second end of the first beam is coupled to an exterior surface of the first rear side rail;
a second beam having a first end and a second end,
wherein the first end of the second beam is coupled to the first beam at a point between the first front side rail and the first rear side rail, and
wherein the second end of the second beam is coupled to the second end of the first beam and the exterior surface of the first rear side rail; and
a third beam having a first end and a second end, wherein a first end of the third beam is coupled to the second beam, and wherein the second end of the third beam is not coupled to the second beam.

16. The ladder according to claim 15, wherein the second end of the third beam is coupled to a foot having a ground contacting portion.

17. The ladder according to claim 16, wherein the ground contacting portion extends away from the third beam in a direction towards a center of the ladder.

18. The ladder according to claim 15, wherein a distance between the foot and a bottom of the platform is approximately 1-1.5 meters.

19. The ladder according to claim 15, wherein a bottom surface of the first beam, a bottom surface of the second beam, and a bottom surface of the third beam are all planar.

* * * * *